United States Patent [19]

Gruber et al.

[11] Patent Number: 4,543,943

[45] Date of Patent: Oct. 1, 1985

[54] HEATER FIRED WITH LIQUID FUEL

[75] Inventors: Reinhold Gruber, Gauting; Dieter Räthel, Mittelstetten, both of Fed. Rep. of Germany

[73] Assignee: Webasto-Werk W. Baier GmbH & Co., Fed. Rep. of Germany

[21] Appl. No.: 473,210

[22] Filed: Mar. 8, 1983

[30] Foreign Application Priority Data

Mar. 11, 1982 [DE] Fed. Rep. of Germany ..... 3208828

[51] Int. Cl.[4] ..... F24H 1/00

[52] U.S. Cl. ..... 126/350 R; 122/182 S; 122/367 C; 165/183

[58] Field of Search ..... 126/350 R; 122/367 C, 122/367 A, 367 R, DIG. 3, 10, 136 C, 135 F, 182 S, 183, 156, 208, 23; 431/242, 243, 115; 165/41, 183; 60/730, 39.51 R, 758

[56] References Cited

U.S. PATENT DOCUMENTS

| | | | |
|---|---|---|---|
| 797,960 | 8/1905 | Junkers | 122/367 C X |
| 2,286,271 | 6/1942 | Higham | 165/183 X |
| 2,646,972 | 7/1953 | Schmid | 165/183 |
| 3,434,533 | 3/1969 | Pignal | 165/183 |

FOREIGN PATENT DOCUMENTS

| | | | |
|---|---|---|---|
| 242357 | 12/1962 | Australia | 122/367 A |
| 2248484 | 9/1978 | Fed. Rep. of Germany . | |
| 1171511 | 1/1957 | France | 122/367 C |
| 25792 | 10/1948 | United Kingdom | 165/183 |
| 1480833 | 7/1977 | United Kingdom | 165/183 |

OTHER PUBLICATIONS

Webasto Publication 771,000, Webasto-Werk Co.

*Primary Examiner*—Randall L. Green

*Attorney, Agent, or Firm*—Sixbey, Friedman & Leedom

[57] ABSTRACT

A heater fired with liquid fuel, especially a vehicle heater, utilizing a liquid heat transfer medium. The heater comprises a tubular combustion chamber and a heat exchanger mounted over the combustion chamber. The heat exchanger deflects exhaust gas leaving the combustion chamber in an axial direction. An annular space, which conducts the hot exhaust gas, is left between the heat exchanger and the combustion chamber. The heat exchanger is provided with ribs on its inner lining which project into the annular space. These ribs are aligned essentially radially and parallel to a central longitudinal axis of the combustion chamber and the heat exchanger. To improve the efficiency of the heat exchanger, at least a portion of the ribs are provided with an exhaust vorticizing arrangement along at least a portion of their length.

33 Claims, 34 Drawing Figures

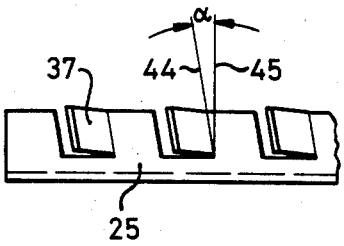
FIG. 29
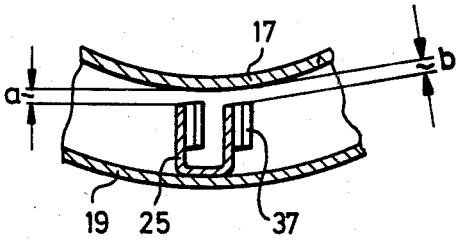
FIG. 30
FIG. 31
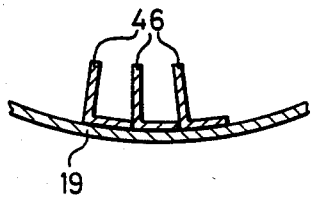
FIG. 32
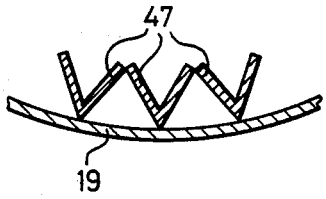
FIG. 33
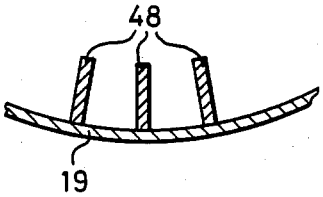
FIG. 34
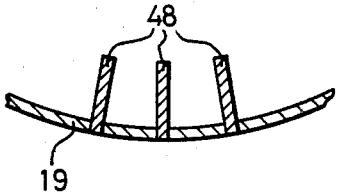

HEATER FIRED WITH LIQUID FUEL

BACKGROUND AND SUMMARY OF THE INVENTION

The invention relates to a heater fired with liquid fuel, especially a vehicle heater with a liquid heat transfer medium, such as water, said heater comprising a tubular combustion chamber and a pot-shaped heat exchanger mounted over the combustion chamber leaving an annular space to conduct hot exhaust gas, said heat exchanger axially deflecting the exhaust gas, and bearing ribs on its inner lining which project into the annular space, said ribs being aligned essentially radially and parallel to the lengthwise axis of the combustion chamber and the heat exchanger.

In known heaters of this type (Webasto Publication 771,000), the ribs are formed of simple continuous U-shaped ribs, which define exhaust gas flow channels between their radial blades, in which channels the exhaust gas flows from the axial deflection point in the direction of an exhaust gas exhaust pipe.

A principal object of the present invention is to further improve the efficiency of the heat exchanger in a heater of this type.

This object is achieved, according to preferred embodiments of the present invention, by at least a portion of the ribs being equipped with means for exhaust gas vorticization over at least a portion of their lengths.

Heat exchangers for vehicle heaters are already known in which a plurality of individual short ribs are disposed, to increase the heat exchange area, nearly transversally to the main flow direction of the hot exhaust gases in the annular space between the combustion chamber and the heat exchanger inner lining. An arrangement of this kind, however, is not only costly from a manufacturing standpoint, but also leads to a high flow resistance to the exhaust gases and consequently a highly undesirable back pressure on combustion. The efficiency of the fan that delivers the combustion air and, consequently, the electrical power draw of the heater are increased disadvantageously.

In contrast, the present invention enables relatively low exhaust gas flow resistance to be achieved, along with an improvement of the efficiency of the heat exchanger through exhaust gas vorticization, said improvement leading to a lower exhaust temperature and, consequently, a reduced exhaust gas volume. This makes it possible to reduce the cross section of the exhaust pipe, resulting in a price reduction for the heater and facilitating its installation.

To produce exhaust gas vorticization, in accordance with preferred embodiments of the present invention, rows of essentially transverse slots are formed in blade arms of lengthwise extending U-shaped ribs, the slots being advantageously opened toward the radially inner edge of the blade arms. The exhaust gas vorticization produces a self-cleaning effect, and contamination of the spaces between the ribs is more difficult.

Greater vorticization and, consequently, a further improvement in efficiency for the heat exchanger can be achieved by displacing blade arm segments, delimited in the lengthwise direction of the ribs by successive pairs of slots, out of the blade arm plane over at least a portion of their extent. The rib segments can advantageously be displaced relative to the lengthwise axis of the ribs. For obtaining such displacing of the blade arm segments, they may be twisted about an axis which runs essentially perpendicularly to the lengthwise axes of the ribs, or may be bent out of the rib plane about an axis which is essentially parallel to the lengthwise axes of the ribs. According to another alternative, the slots can be in the form of essentially L-shaped cuts and the free parts of the rib segments can be bent outward, out of the rib plane, by twisting.

The ratio between the mutual spacing of adjacent slots, in the lengthwise direction of the ribs, and the depth of the slots is advantageously in the range from 5:1 to 0.5:1, and is preferably on the order of 1:1. At much higher ratios, the vorticization effect is indesirably weak. Excessively low values for this ratio, on the other hand, produce numbers of slots that are so great that the parts of the rib areas that are involved are lost to heat transfer.

In order to keep area losses of ribs actively involved in heat transfer small, the slot width is advantageously minimized. Thus, sawn and, therefore, relatively narrow slots are better than wide, punched slots.

According to a modified embodiment of the present invention, turbulence-creating bodies can also be inserted between circumferentially adjacent ribs as a means of exhaust gas vorticization. In particular, vorticizing strips of sheet metal can be used as turbulence-creating bodies, said strips being twisted about an axis which is parallel to the lengthwise axes of the ribs.

Preferably, the ribs are free of exhaust gas vorticization means in the vicinity of the gas reversal point, because the heat load is greatest in this area, and there is a danger than the vorticization means, especially twisted ribs, will burn away relatively rapidly at this point, resulting in gradual destruction of the heat exchanger.

Advantageously, the ribs can be formed of essentially U-shaped blades, whose central ribs are connected with the inner lining of the heat exchanger and which are distributed circumferentially at evenly spaced intervals over the inner lining of the heat exchanger.

Instead, L- or V-shaped blades can be provided for forming the ribs. It is also possible to install the ribs individually on the inner lining of the heat exchanger or to insert them through the inner lining.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 29 is a partial view of a U-shaped blade similar to FIG. 18, wherein, however, portions of the rib segments have been bent out from the rib plane about an axis which runs diagonally to the lengthwise axis of the ribs;

FIG. 30 is a partial section through the combustion tube and the heat exchanger inner lining using a U-shaped blade, corresponding to FIG. 29;

FIGS. 31 and 32 are schematic partial views of the heat exchanger inner lining with L- and V-shaped blades; and FIGS. 33 and 34 are partial views similar to FIGS. 31 and 32, with ribs mounted individually on the inner lining or inserted therethrough.

DETAILED DESCRIPTION OF THE PREFERRED EMBODIMENTS

Figure 1:
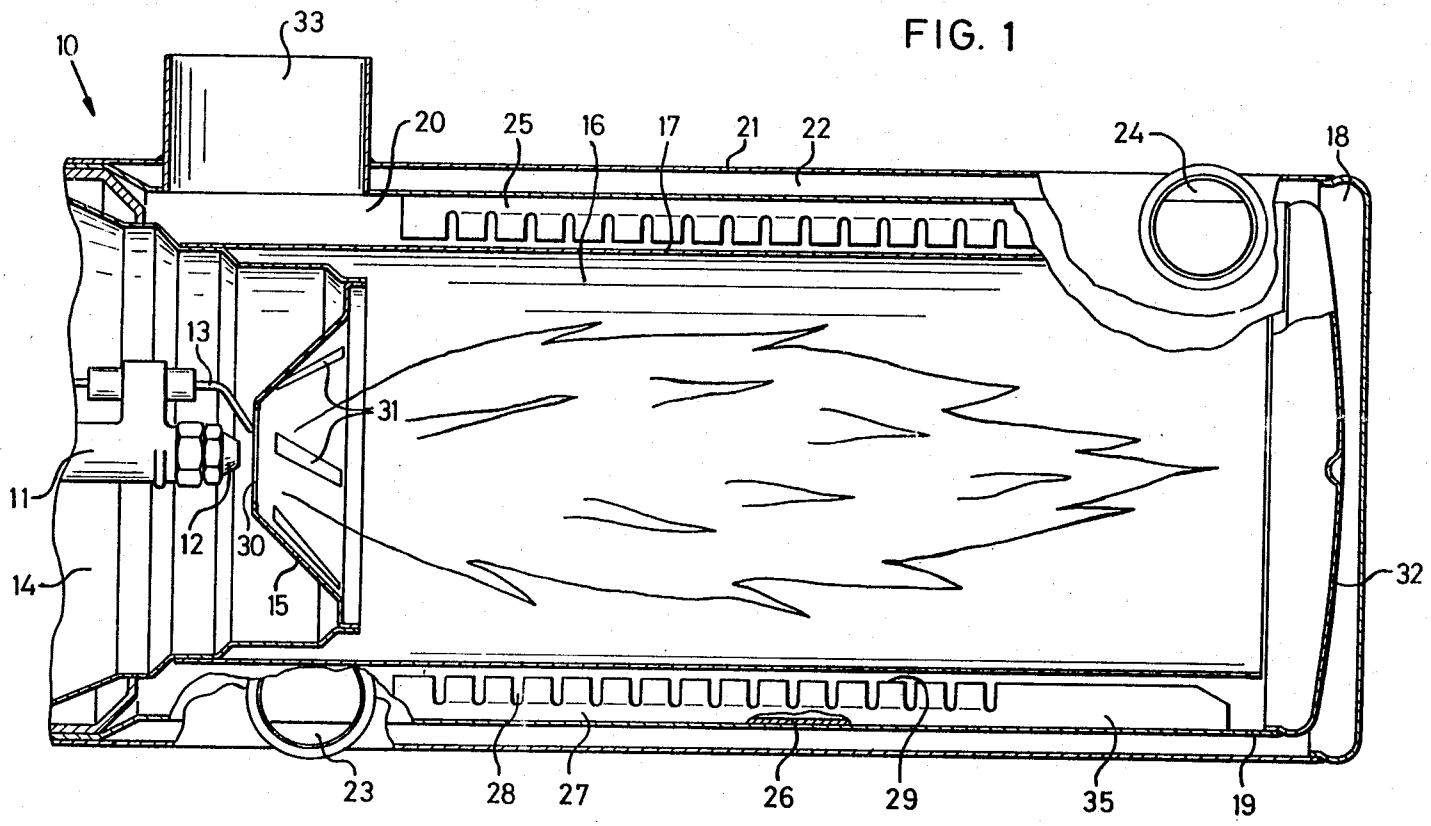
FIG. 1 is a partial lengthwise section through a heater designed according to the invention.

The heater 10 shown in FIG. 1 comprises a jet holder 11 with an atomizer nozzle 12 to which liquid fuel is supplied by a fuel pump (not shown). The jet holder 11 supports an ignition electrode 13 for igniting atomized fuel leaving the atomizer nozzle 12. The atomizer nozzle 12 is located in a chamber 14 that is delimited relative to a combustion chamber 16 by means of a swirl body 15. The combustion chamber 16 is circumferentially bounded by a fire tube 17. A pot-shaped heat exchanger 18 is mounted over the combustion chamber 16, whereby an annular space 20 is left between the fire tube 17 and an inner lining 19 of the heat exchanger 18. An annular space 22, formed between inner lining 19 and an outer jacket 21 of the heat exchanger 18, conducts a liquid heat transfer medium, generally water. The heat transfer medium enters annular space 22 through an inlet stub 23 and leaves annular space 22 through an outlet stub 24. U-shaped ribs 25, having a connecting bridge 26 between a pair of blade arms, are distributed circumferentially on the inner lining 19. The middle, connecting bridge 26 of each rib 25 is connected to inner lining 19, so that the two blade arms 27 project therefrom. Each of the blade arms 27 are provided with a series of essentially transverse slots 28, said slots being open to the radially inside free edge 29 of the ribs.

When the heater is in operation, fuel is sprayed out of the atomizer nozzle 12, while combustion air is simultaneously delivered to the chamber 14 by means of a combustion air blower (not shown). Atomized fuel enters through a central opening 30 in the swirl body 15 into the combustion chamber 16, where it mixes with the combustion air passing through both the central opening 30 and slots 31 in the swirl body 15. The mixture burns in the combustion chamber 16, and the resultant hot exhaust gases are deflected back in an opposite axial direction at end wall 32 of heat exchanger 18, in order to traverse annular space 20 toward the exhaust gas outlet stub 33. The hot exhaust gases, thereby, give off heat via the inner lining 19 of the heat exchanger 18 and via ribs 25 to the liquid heat transfer medium in the annular chamber 22.

The combustion air blower, the fuel pump, and the drive for these assemblies can be constructed in any known fashion (e.g., as described and shown in greater detail in German AS No. 22 48 484).

Figure 17:
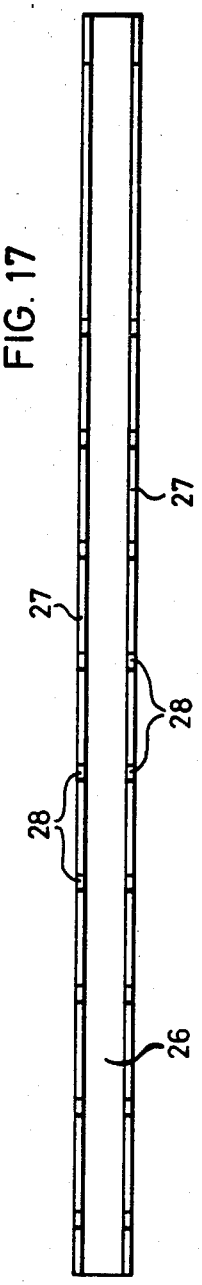
FIG. 17 is a top view of a blade of the type shown in FIGS. 14 and 15, with slots aligned transversally.

Slits 28, in the embodiments shown in FIGS. 14 to 17, provide for vorticization of the hot exhaust gas flowing through the annular space 20, whereby the heat given up from the hot gas to ribs 25 and inner lining 19 is made more intensive. This results in improved efficiency of the heat exchanger 18. Slits 28 can be sawn or punched, for example. It is advantageous to keep the width of the slots as small as possible, in order to minimize the loss of active heat transfer area. In the embodiment shown in FIG. 16, the slots 28 of one blade arm 27 of rib 25 are longitudinally staggered along the blade arm relative to the slots 28 of the other blade arm of this rib. On the other hand, the slots 28 of both blade arms 27 of a rib may be aligned with each other, as shown in FIG. 17.

Rib segments 34, formed between each pair of slots 28, are, preferably, made more or less square, i.e., the ratio between the spacing between pairs of slots 28 and slot depth is approximately 1:1. In general, however, a ratio between the slot spacing and the slot depth in the range from 5:1 to 0.5:1 may be used. Excessively great slot spacings have a disadvantageous impact upon the vorticization effect. On the other hand, with excessive reduction of slot spacing, an important part of the active surface of the ribs for heat exchange is lost. The optimum ratio between the slot spacing and the slot depth depends on a number of factors, such as the combustion temperatures reached, the dimensions of the combustion chamber and the heat exchanger, and the nature of the heat transfer medium used, but can be determined empirically in each individual case by comparative testing.

In order to prevent the blade arms 27 from being burned away in the vicinity of the axial change in the direction of the exhaust gas, an end portion 35 of the blade arms 27 adjacent to this area (end wall 32) is free of slots 28. As shown in the drawings, this end portion 35 constitutes on the order of approximately 25% of the length of ribs.

Figure 2:
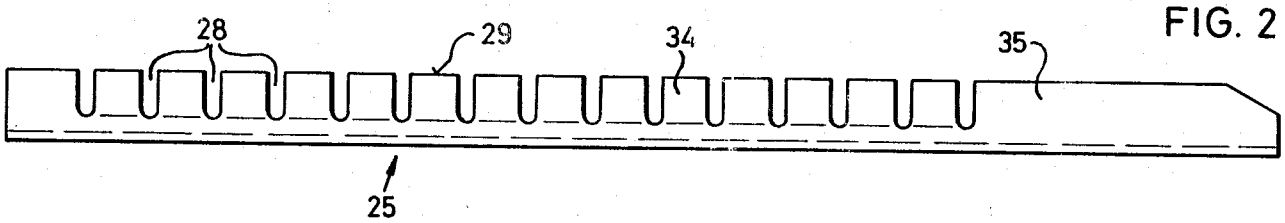
FIG. 2 is a side view, on an enlarged scale, of one of the U-shaped blades of the heat exchanger in the heater shown in FIG. 1.
Figure 3:
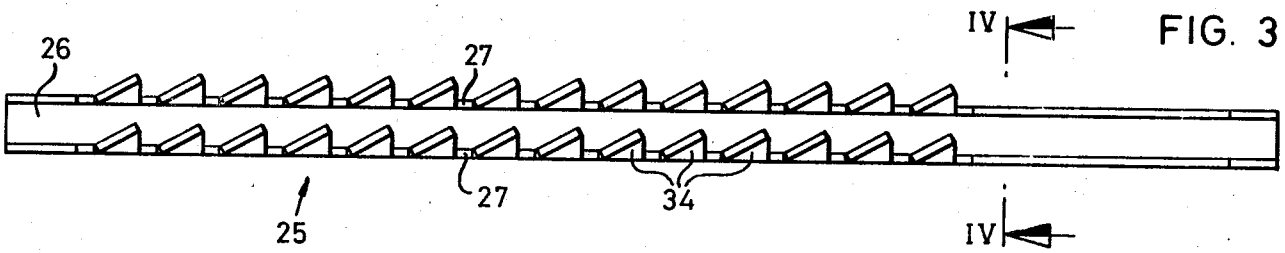
FIGS. 3 and 5 are top views of the blade shown in FIG. 2.
Figure 5:
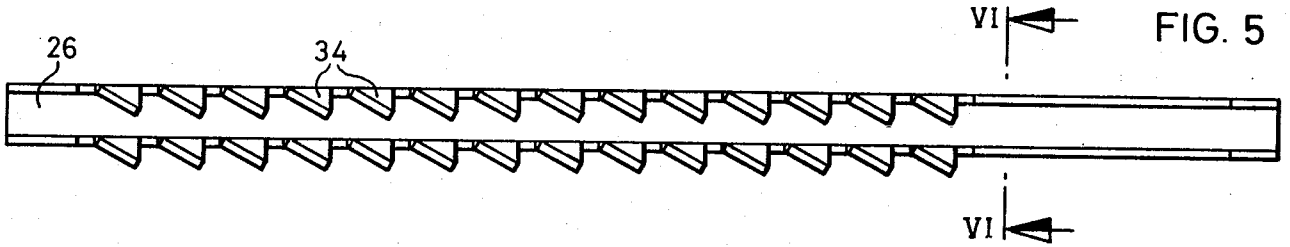
Figure 7:
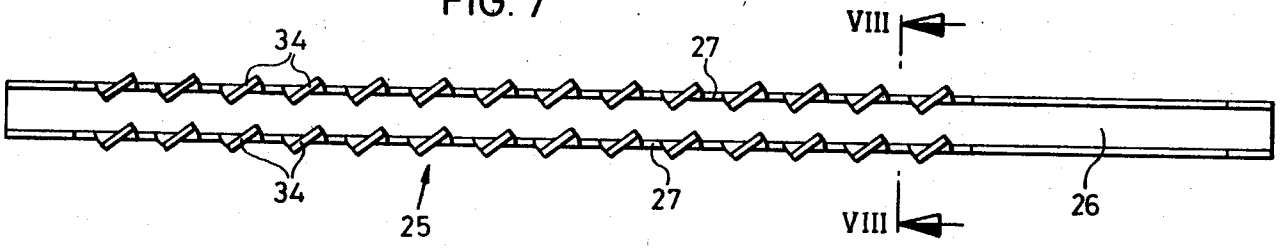
FIG. 7 is a top view of a blade with a twisting axis different from that shown in FIGS. 3–6.
Figure 9:
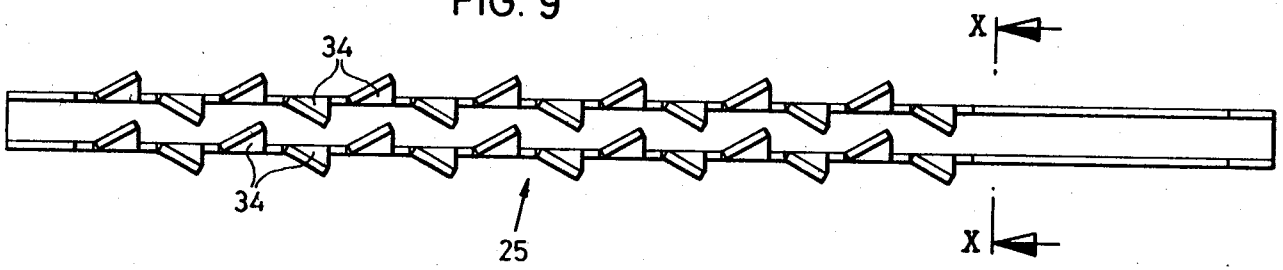
FIG. 9 is a top view of a blade with rib segments which are twisted differently and alternately in the lengthwise direction.
Figure 10:
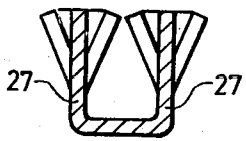
FIG. 10 is a section along Line X—X in FIG. 9.
Figure 8:
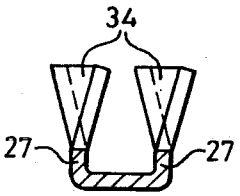
FIG. 8 is a section along Line VIII—VIII in FIG. 7.
Figure 6:
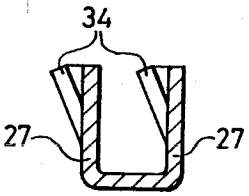
FIGS. 4 and 6 are sections along Lines IV—IV and VI—VI in FIGS. 3 and 5, respectively.
Figure 4:
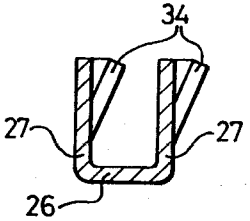

An additional improvement in efficiency can be achieved if the blade arms are not merely slotted, but are twisted in addition, as is the case in the embodiments shown in FIGS. 2 to 13 and 18 to 24. According to the embodiment shown in FIGS. 2 to 4, 7 and 8, blade arm segments 34 are twisted in the same direction by being bent about an axis running essentially perpendicularly to the lengthwise axes of the ribs. FIGS. 5 and 6 show the same type of twisting as FIGS. 3 and 4, but in the opposite direction. In the embodiment shown in FIGS. 9 and 10, longitudinally successive blade arm segments 34, of the type shown in FIGS. 2 to 4, are twisted in opposite directions. The blade segments of FIGS. 7 and 8 differ from those of FIGS. 1–6 in that the twist axis is centrally located so that, as shown in FIG. 8, opposite radial edges of the segment are displaced an equal distance, in opposite directions, out of the blade plane, while, in accordance with FIGS. 1–6, the twist axis is a one of the radial edges so that each blade segment is displaced out of the blade plane in only a single direction.

Figure 11:
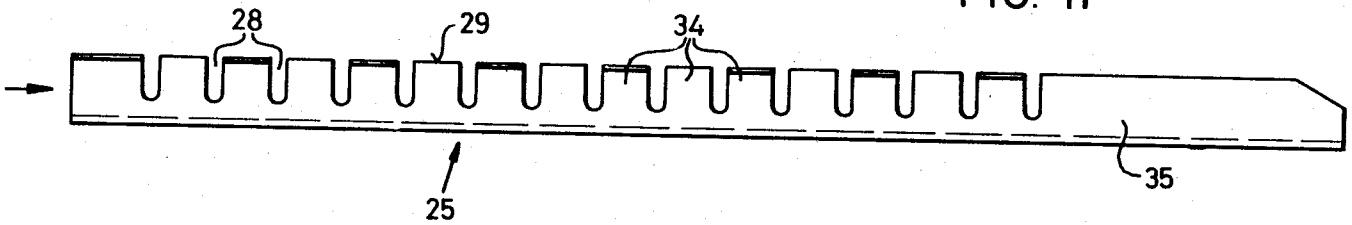
FIG. 11 is a side view of a U-shaped blade, corresponding to a further modified embodiment of the invention.
Figure 12:
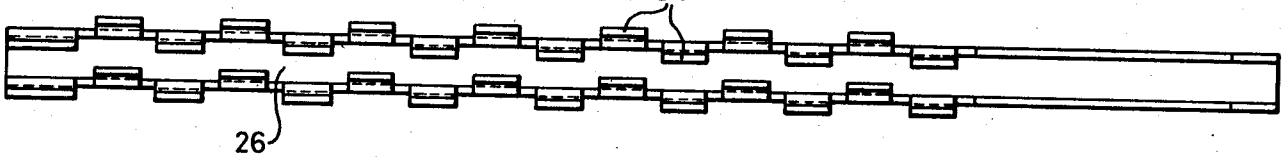
FIG. 12 is a top view of the blade shown in FIG. 11.
Figure 13:
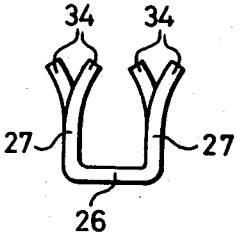
FIG. 13 is an end view of the blade, viewed from the side, which is at the left in FIG. 11.
Figure 15:
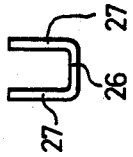
FIG. 15 is an end view of the blade shown in FIG. 14, from the left side of FIG. 14.
Figure 14:
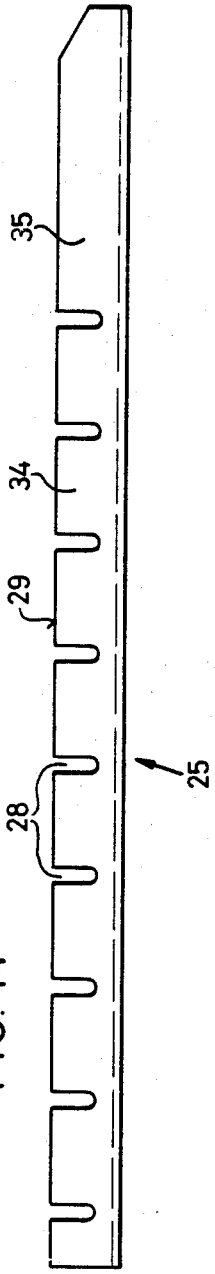
FIG. 14 is a side view of a U-shaped blade which is simply slotted.
Figure 16:
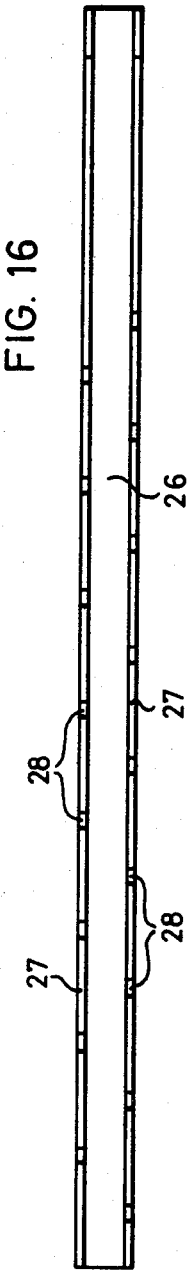
FIG. 16 is a top view of the blade shown in FIGS. 14 and 15, with slots which are mutually staggered lengthwise.

FIGS. 11 to 13 show an embodiment wherein the blade segments 34 are bent out of the plane of the blade arm about an axis which runs essentially parallel to the lengthwise axes of the ribs.

Figure 18:
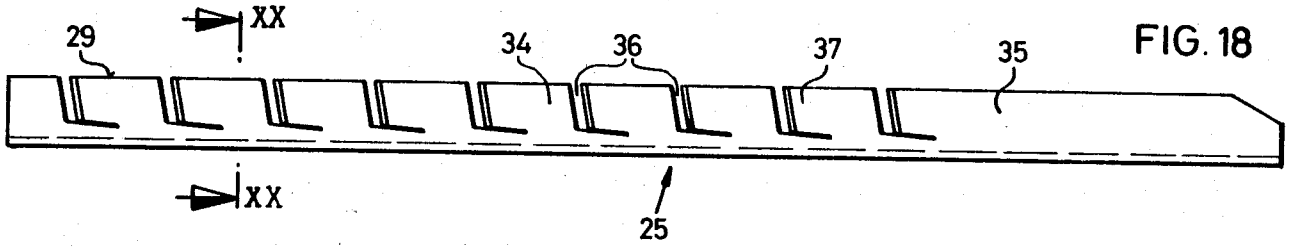
FIG. 18 is a side view of a U-shaped blade corresponding to a further modified embodiment.
Figure 19:
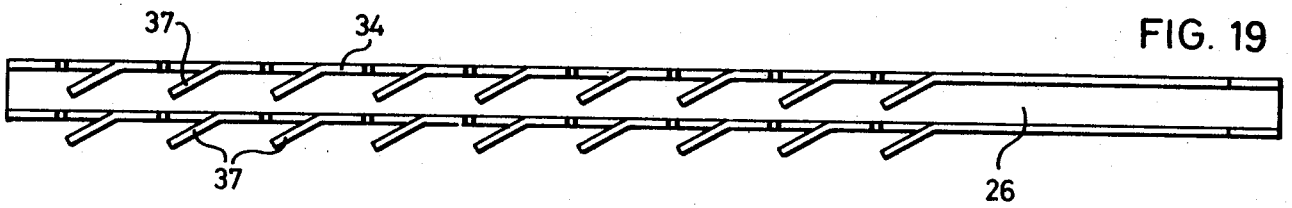
FIG. 19 is a top view of the blade shown in FIG. 18.
Figure 21:
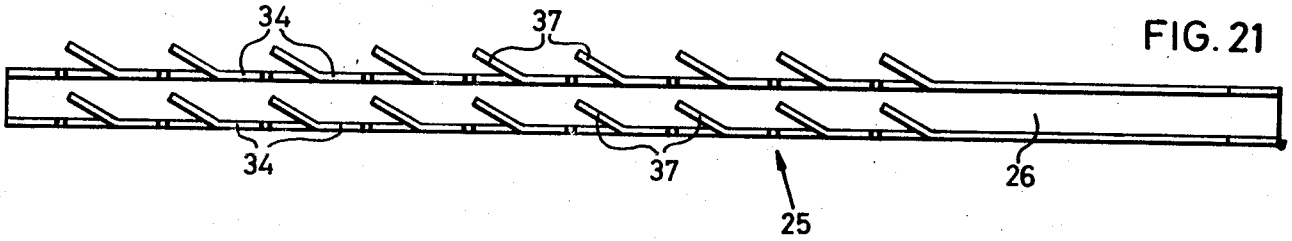
FIG. 21 is a top view of a blade similar to FIGS. 18 to 20, but with reversed direction of twisting.
Figure 22:
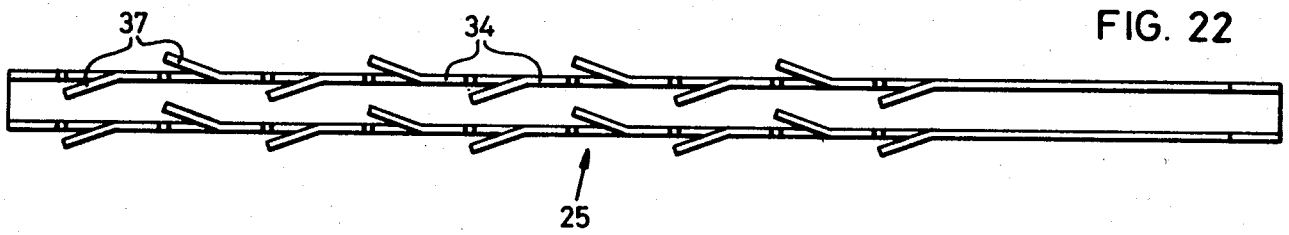
FIG. 22 is a top view of a blade with L-shaped cuts and a twisting direction which alternates lengthwise.
Figure 23:
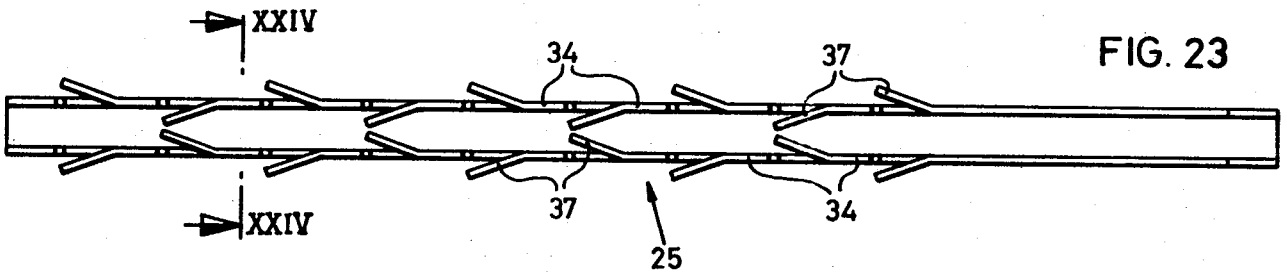
FIG. 23 is a top view of a further modified form of twisting.
Figure 24:
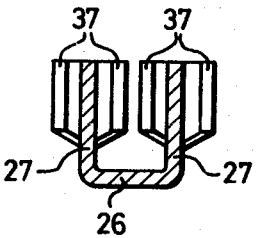
FIG. 24 is a section along Line XXIV—XXIV in FIG. 23.
Figure 20:
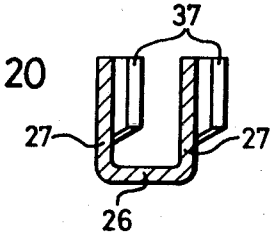
FIG. 20 is a section along Line XX—XX in FIG. 18.
Figure 25:
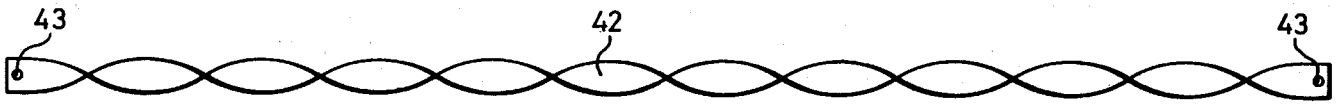
FIG. 25 is a vorticization strip.
Figure 26:
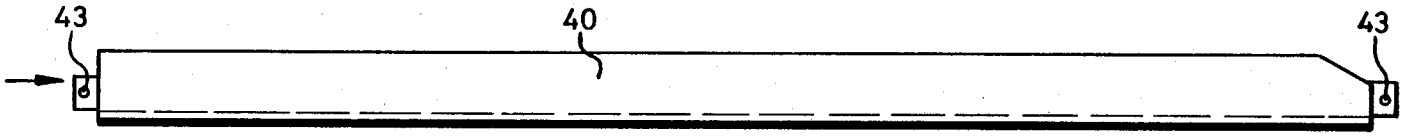
FIG. 26 is a side view of a U-shaped blade with a vorticization strip fitted according to FIG. 25.
Figure 27:
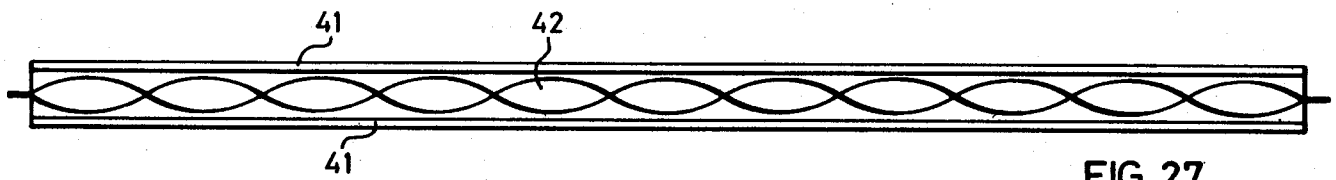
FIG. 27 is a top view of the U-shaped blade with a vorticization strip according to FIG. 26.
Figure 28:
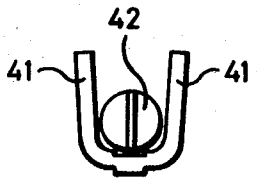
FIG. 28 is an end view of the arrangement shown in FIG. 26, viewed from the left side in FIG. 26.

Instead of simple slots 28 extending crosswise of the blade arms, the embodiments shown in FIGS. 18 to 24 utilize essentially L-shaped cuts 36. The free parts 37 of the blade arm segments 34, delimited by the L cuts 36, are bent out of the plane of their blade arm about an axis that runs essentially perpendicularly to the lengthwise axes of the ribs. In the case of FIGS. 18 to 20, all of the blade arm segments 34 are twisted in one direction, while, in the embodiment shown in FIG. 21, all of the blade arm segments 34 are twisted in the opposite direction. FIG. 22 shows a similar embodiment wherein transversely adjacent blade arm segments are twisted in the same direction, but longitudinally adjacent blade arm segments are bent in opposite transverse directions, while, in the embodiment shown in FIGS. 23 and 24, both longitudinally and transversely adjacent blade arm pairs are twisted in opposite directions, so that the blade segments are twisted to alternately extend inwardly and outwardly along the length of the rib.

FIGS. 25 to 28 show an embodiment in which unslotted U-shaped ribs 40 are provided, having blade arms 41, and into each of which blades a vorticization strip 42 is inserted, said strip being twisted about an axis which is parallel to the lengthwise axes of the ribs. Vorticization strip 42 can be held in the ribs 40, for example, by a wire ring being inserted through openings 43 at each end of the sheet metal strips, said ring being disposed coaxially with respect to fire tube 17, so that all of strips 42 are held by a single part of the rings.

The embodiment shown in FIGS. 29 and 30 is largely similar to that shown in FIGS. 18 to 20; however, in this embodiment, free parts 37 of the blade arm segments are bent outward from the rib plane about an axis 44 which forms an angle $\alpha$ with a line 45 that is in the plane of the blade arm and normal to the lengthwise axis thereof. This angle is advantageously chosen so that the spacing a (FIG. 30) between the free end of the part of the blade arm segment 37, that lies in the blade arm plane and the fire tube 17, is essentially equal to the distance b between the outer end of free end part 37 and the fire tube.

Instead of U-shaped ribs, L-shaped or V-shaped blades 46, 47, respectively, like those shown in FIGS. 31 and 32 may be used, connected with the inner lining in the manner shown. Other blade shapes are also possible. In addition, in the manner shown in FIGS. 33 and 34, ribs 48 can also be mounted on inner lining 19 individually, or can be inserted through slots in the inner lining and appropriately sealed. It is understood in this connection that, even in these modified embodiments, the ribs may be slotted or twisted in any of the manners shown in FIGS. 2 to 24 above, or turbulencecreating bodies, for example, like those shown in FIGS. 25 to 28, may be inserted between these ribs.

In the table which follows, the efficiency, exhaust gas temperature differential, and fuel consumption are compiled for water heaters that, with the exception of the nature and number of U-shaped blades mounted on the inner lining of the heat exchanger, were similar and each had a power of 23.3 kW. The measurements were made under the same operating conditions.

TABLE 1

| Heat Exchanger Design | Efficiency % | Exhaust Gas Temperature Differential K | Fuel Consumption kg/h |
|---|---|---|---|
| 27 U-shaped ribs, not slotted, not twisted | 81.0 | 334 | 2.42 |
| 27 U-shaped ribs with vorticization strips inserted (FIGS. 25 to 28) | 83.9 | 288 | 2.32 |
| 26 U-shaped ribs, slotted only (slot width 3 mm) not twisted (FIG. 17) | 82.6 | 312 | 2.40 |
| 26 U-shaped blades slotted and twisted (slot width 3 mm) (FIG. 3) | 85.3 | 267 | 2.30 |
| 26 U-shaped blades slotted and twisted (slot width 0.8 mm) (FIG. 3) | 86.8 | 238 | 2.24 |

From this table, it can be seen that, in all instances, use of the present invention enables an increase in the efficiency of the heat exchanger to be achieved that is accompanied by an advantageous lowering of fuel consumption.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A liquid fuel fired heater, especially a vehicle heater, utilizing a liquid heat transfer medium, comprising a tube defining a combustion chamber and a pot-shaped heat exchanger mounted over the combustion chamber tube, so as to leave an annular space therebetween for conducting hot exhaust gas, said exchanger being constructed for deflecting the exhaust gas, in an axial direction, from said combustion chamber to said annular space, and having ribs on an internal lining thereof which project into the annular space, said ribs being arranged essentially radially and parallel to a central longitudinal axis of the combustion chamber and the heat exchanger, wherein at least some of the ribs are equipped, over at least a portion of their lengths, with means for vorticization of the exhaust gas;

wherein the ribs equipped with the vorticization means are each comprised of at least one row of blades having a longitudinally extending free edge, essentially transversely running slots being provided in each blade, said slots being open in a direction away from said heat exchanger inner lining at said free edge, blade segments being formed therebetween, and said ribs are free of said vorticization means in an end portion at the vicinity of the area wherein said deflecting of the exhaust gas occurs, said end portion constituting on the order of approximately 25% of the length of the ribs, for preventing damage to said vorticization means by burning.

2. A heater according to claim 1 wherein said blade segments are displaced, at least in part, out of a longitudinally extending center plane of their respective blade.

3. A heater according to claim 2, wherein the blade segments are twisted relative to a longitudinal axis of their respective blade.

4. A heater according to claim 3, wherein the blade segments of a respective blade are all twisted in the same direction.

5. A heater according to claim 4, wherein the ratio between the spacing of longitudinally adjacent slots and the depth of the slots is in the range between 5:1 to 0.5:1.

6. A heater according to claim 4, wherein said ratio is 1:1.

7. A heater according to claim 4, wherein a clearance space exists between the free edge of the blades and a circumferential outer surface of the combustion chamber tube.

8. A heater according to claim 4, wherein the ribs provided with said vorticization means have an essentially U-shape cross section and comprise a pair of said blades interconnected by a connecting bridge.

9. A heater according to claim 3, wherein longitudinally adjacent blade segments are twisted in opposite directions.

10. A heater according to claim 2, wherein the blade segments are bent about an axis which runs essentially perpendicular to a longitudinal axis of their respective blade.

11. A heater according to claim 10, wherein the blade segments of a respective blade are all twisted in the same direction.

12. A heater according to claim 10, wherein longitudinally adjacent blade segments are twisted in opposite directions.

13. A heater according to claim 2, wherein the blade segments are bent about an axis which is essentially parallel to a longitudinal axis of their respective blade.

14. A heater according to claim 13, wherein the blade segments of a respective blade are all twisted in the same direction.

15. A heater according to claim 13, wherein longitudinally adjacent blade segments are twisted in opposite directions.

16. A heater according to claim 2, wherein said slots are made in the form of essentially L-shaped cuts.

17. A heater according to claim 16, wherein the blade segments of a respective blade are all twisted in the same direction.

18. A heater according to claim 16, wherein longitudinally adjacent blade segments are twisted.

19. A heater according to claim 1, wherein the ratio between the spacing of longitudinally adjacent slots and the depth of the slots is in the range from 5:1 to 0.5:1.

20. A heater according to claim 19, wherein said ratio is approximately 1:1.

21. A heater according to claim 19, wherein the width of the slots is narrow in comparison to the width of said blade segments.

22. A heater according to claim 19, wherein said blade segments are displaced, at least in part, out of a longitudinally extending center plane of their respective blade.

23. A heater according to claim 19, wherein longitudinally adjacent blade segments are twisted in opposite directions.

24. A heater according to claim 1, wherein said ribs are formed of an essentially U-shape having radially projecting blades connected together by a connecting bridge which abuts the inner lining of the heat exchanger, said ribs being uniformly distributed circumferentially about the inner lining of the heat exchanger.

25. A heater according to claim 24, wherein the blade segments of a respective blade are all twisted in the same direction.

26. A heater according to claim 24, wherein longitudinally adjacent blade segments are twisted in opposite directions.

27. A heater according to claim 1, wherein the ribs are formed of an essentially L-shape having a base leg connected to the inner lining of the heat exchanger, a blade formed by radially projecting leg thereof, said ribs being uniformly distributed circumferentially about the inner lining.

28. A heater according to claim 27, wherein the blade segments of a respective blade are all twisted in the same direction.

29. A heater according to claim 27, wherein longitudinally adjacent blade segments are twisted in opposite directions.

30. A heater according to claim 1, wherein the ribs are formed of an essentially V-shape having inwardly projecting blades and being connected with the inner lining in the vicinity of points of the V-shape.

31. A heater according to claim 30, wherein said blade segments are displaced, at least in part, out of a longitudinally extending center plane of their respective blade.

32. A heater according to claim 1, wherein the ribs are in the form of individual blades.

33. A heater according to claim 32, wherein the ribs are mounted to the inner lining of the heat exchanger by being inserted therethrough.

* * * * *